US008142093B2

(12) United States Patent
Vanoncini

(10) Patent No.: US 8,142,093 B2
(45) Date of Patent: Mar. 27, 2012

(54) WIPER DEVICE FOR COSMETIC PRODUCTS CONTAINERS

(75) Inventor: Stefano Vanoncini, Olgiate Molgora (IT)

(73) Assignee: Brivaplast S.R.L., Milan (IT)

( * ) Notice: Subject to any disclaimer, the term of this patent is extended or adjusted under 35 U.S.C. 154(b) by 1061 days.

(21) Appl. No.: 11/658,512

(22) PCT Filed: May 30, 2005

(86) PCT No.: PCT/IB2005/001819

§ 371 (c)(1),
(2), (4) Date: Mar. 1, 2008

(87) PCT Pub. No.: WO2006/013408

PCT Pub. Date: Feb. 9, 2006

(65) Prior Publication Data

US 2008/0219747 A1 Sep. 11, 2008

(30) Foreign Application Priority Data

Jul. 27, 2004 (IT) ..... MI2004A01513

(51) Int. Cl.
*A46B 17/08* (2006.01)

(52) U.S. Cl. ..... 401/122; 401/121; 401/124; 401/129

(58) Field of Classification Search ..... 401/118, 401/121, 122, 124, 126, 129
See application file for complete search history.

(56) References Cited

U.S. PATENT DOCUMENTS

| | | | | |
|---|---|---|---|---|
| 3,469,928 | A | 9/1969 | Widegren | |
| 4,194,848 | A | 3/1980 | Kingsford | |
| 5,190,389 | A | 3/1993 | Vasas | |
| 5,875,791 | A | 3/1999 | Sheffler et al. | |
| 6,062,757 | A | 5/2000 | Gueret | |
| 6,168,334 | B1 * | 1/2001 | Fordham | 401/122 |
| 6,238,116 | B1 * | 5/2001 | Smith et al. | 401/122 |
| 6,503,487 | B1 * | 1/2003 | Ohba | 132/218 |
| 7,186,044 | B2 | 3/2007 | Bailly | |
| 2002/0195117 | A1 | 12/2002 | Bailly | |

FOREIGN PATENT DOCUMENTS

| | | |
|---|---|---|
| DE | 1932002 | 1/1971 |
| EP | 1275322 B1 | 1/2003 |
| GB | 2 063 823 A | 6/1981 |
| GB | 2 312 617 A | 11/1997 |

* cited by examiner

*Primary Examiner* — Steven J Ganey
(74) *Attorney, Agent, or Firm* — Pearne & Gordon LLP

(57) ABSTRACT

A wiper device for containers of cosmetic products comprises a wiper element (10) to be mounted in a casing (2) of a container (1) for cosmetic products and designed to come into contact with an applicator (6) housed in the casing (2), at least during pulling out of the applicator (6) from the casing (2). The wiper device further comprises means (11) for engagement of the wiper element (10) with the casing (2) and at least one seal (12) to be installed close to an opening (3) of the casing (2) and adapted for abutment against a closing cap (4) of the container (1), to ensure hermetic tightness of the container (1) and avoid escape of the cosmetic product.

12 Claims, 4 Drawing Sheets

WIPER DEVICE FOR COSMETIC PRODUCTS CONTAINERS

The present invention relates to a wiper device for cosmetic product containers, a process for manufacturing a wiper device for cosmetic product containers and a container of cosmetic products comprising such a device.

Known in the art are containers designed to hold cosmetic products preferably in a liquid or semiliquid form, such as mascara, and to enable application of same. Such containers comprise a casing usually of cylindrical shape having an opening closed by a removable cap at an end thereof. Mounted on the cap is a stem carrying an applicator, in the form of a brush for example. When the cap is put on the container for closing it, the applicator is at the inside of the casing, being dipped in the cosmetic product. Within the casing, close to the opening, a wiper device is also installed the function of which is to eliminate, during drawing of the stem out of the casing, the excess cosmetic product that is present on the stem itself and on the applicator.

A wiper device of known type comprises a hollow body, the shape of which matches that of the casing opening and inserted by interference fit into the opening itself. The hollow body at the lower part thereof has a narrowing passage usually defined by a frustoconical tailpiece of flexible material tapering towards the casing bottom. When the applicator is inserted into the casing, the tailpiece is caused to rub against the same offering a weak resistance, while when the applicator is drawn out of the casing, the tailpiece interferes with the stem and with the applicator's bristles to remove the excess cosmetic product therefrom.

Some containers of known type further comprise a seal of elastically yielding material mounted on the cap. When the cap is tightened on the casing, the seal is disposed in abutment against a rigid counter-surface, to ensure hermetic tightness of the assembly.

Alternatively, both the cap and casing are made with very narrow tolerances, to ensure a tight coupling directly between the respective relatively rigid parts, currently of plastic material.

The Applicant has found that the wiper devices and containers of cosmetic products of the above described type can be improved under different points of view, both in terms of efficiency, and as regards simplification in construction and increase in the production speed, which will bring about a reduction in costs.

In fact, as already mentioned above, in the case of containers that do non contemplate use of seals mounted on the cap, couplings with minimum tolerances must be made. The necessary expedients to obtain these minimum tolerances and the waste of product for goods that are not within the required standards make the containers manufactured in this manner particularly expensive.

When seals of yielding material are adopted for application into the cap, by gluing or interference fit, the process disadvantageously involves a further step and a proper machine for insertion of the seals. In addition, detachment of the seals from the caps may occur after a predetermined number of opening/closing operations.

Selection of the material for manufacturing the wiper device is very difficult too because it must meet opposite requirements that would impose use of very soft and resilient materials on the one hand, to ensure an efficient removal of the excess material from the applicator, and use of rather rigid materials on the other hand, to facilitate assembling of the wiper device by forced fitting into the bottle opening.

Accordingly, the present invention aims at providing a wiper device for cosmetic product containers, a process for manufacturing a wiper device for cosmetic product containers and a container of cosmetic products comprising such a device that are able to eliminate the above mentioned problems.

In particular, it is an object of the present invention to propose a container for cosmetic products that is of simple structure and construction and also strong and cheap.

It is a further object of the invention to propose a wiper device for cosmetic product containers also performing a sealing function on the cap and therefore enabling coupling of the cap with further seals to be avoided.

A still further object of the invention is to devise a process for manufacturing a wiper device for cosmetic product containers that can be carried into effect in a simple and quick manner.

The foregoing and further objects that will become more apparent during the following description, are achieved by a wiper device for cosmetic product containers comprising the features set forth below, a process for manufacturing a wiper device for cosmetic product containers as set forth below and a container of cosmetic products comprising such a device as set forth below.

Further features and advantages will be best understood from the detailed description of a preferred but not exclusive embodiment of a wiper device for cosmetic product containers, a process for manufacturing a wiper device for cosmetic product containers and a container of cosmetic products comprising such a device, in accordance with the present invention.

This description will be set out hereinafter with reference to the accompanying drawings, given by way of non-limiting example, in which.

Figure 1:
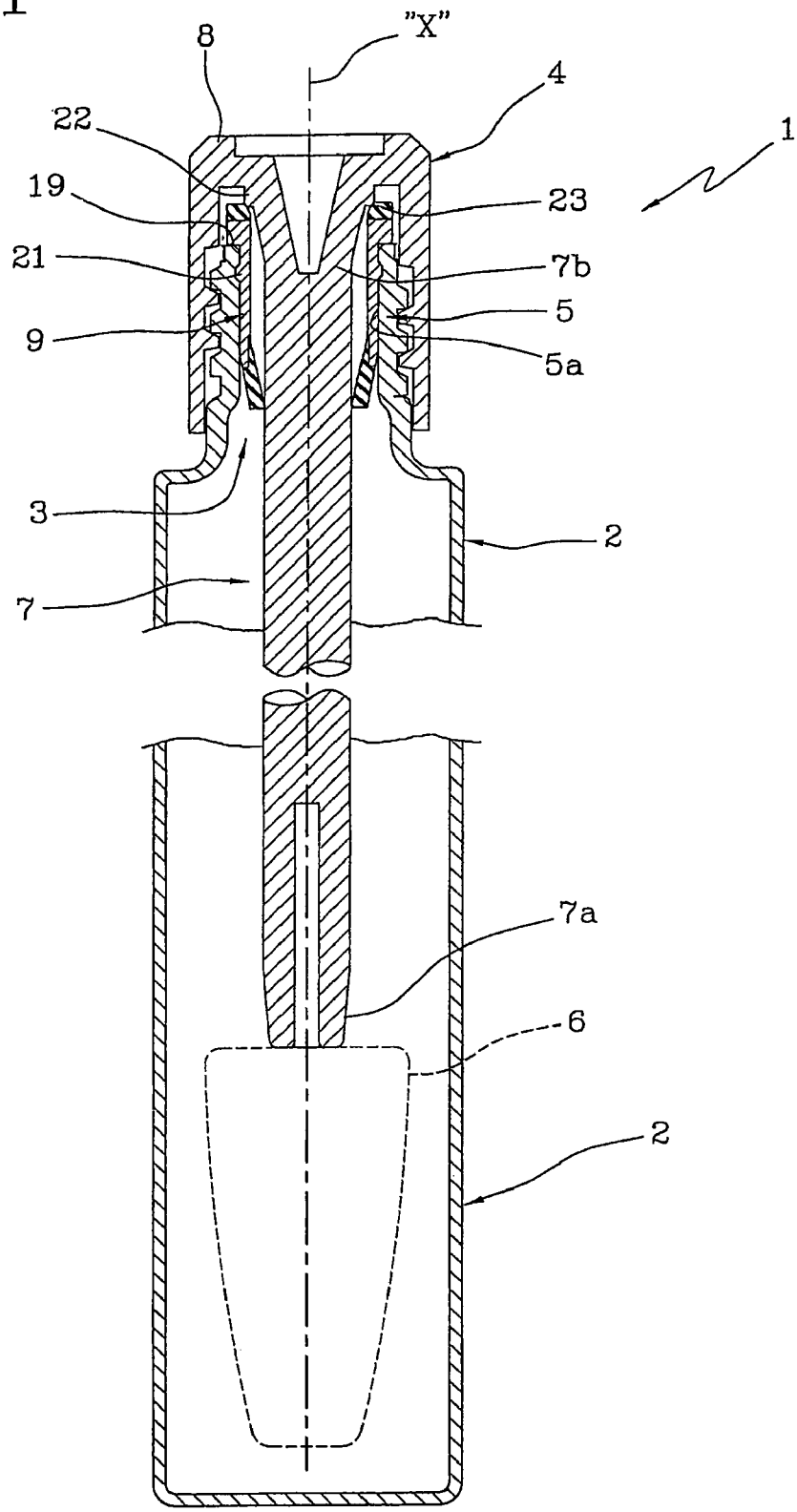
FIG. 1 is a partial view in section of a container for cosmetic products equipped with a wiper device in accordance with a first embodiment of the present invention.

With reference to the drawings, a container of cosmetic products, preferably mascara, in accordance with the present invention has been generally identified by reference numeral 1.

The container 1 comprises a casing 2, only partly shown in FIG. 1 and designed to hold a cosmetic product, mascara for example.

Casing 2 has an elongated, preferably but not exclusively of cylindrical shape with a circular section and is provided with an opening 3 through which it is possible to accede to the product contained therein. A cap 4 is removably mounted on casing 2 to close opening 3.

As shown in the accompanying figures, opening 3 is preferably delimited by a neck 5 extending coaxial with a longitudinal axis "X" of the casing 2. A thread is provided on neck 5 and the cap 4 has a cup-shaped conformation with an inner threading to be threadingly coupled with said neck 5.

Container 1 further comprises an applicator 6 integral with cap 4. The applicator 6, of a type known by itself and therefore diagrammatically shown and not described in detail, is currently defined by a brush mounted to a first end 7*a* of a stem 7 the second end 7*b* of which is fastened to cap 4. The stem 7 extends along the longitudinal axis "X" of casing 2 and, as shown in FIG. 1, is joined to a base 8 of the cup-shaped cap 4, forming a unitary body with the cap 4 itself. When cap 4 is disposed on casing 2 closing it, the applicator 6 is placed within casing 2 and dipped into the cosmetic product.

Figure 2:
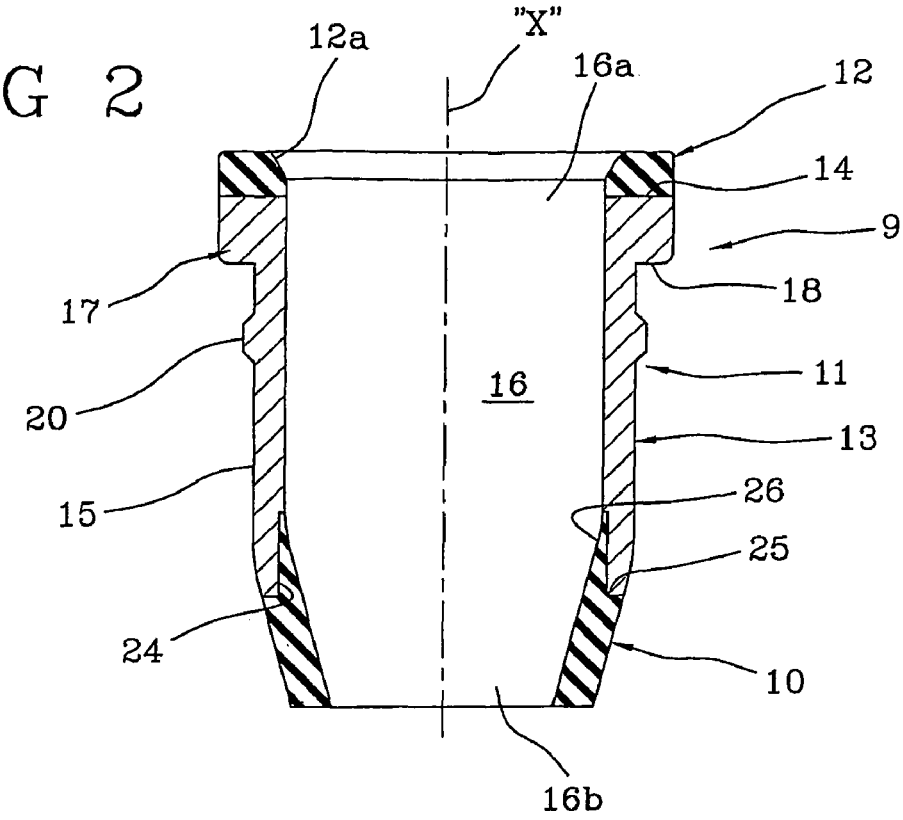
FIG. 2 is an enlarged view of the wiper device seen in FIG. 1.
Figure 3:
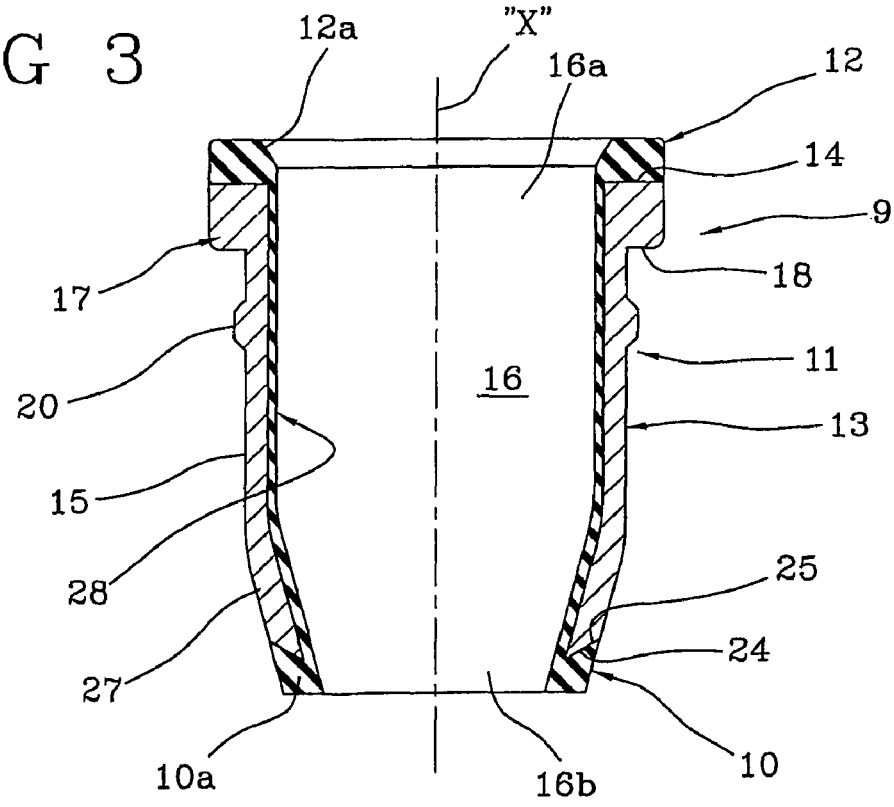
FIG. 3 is an enlarged view of a second embodiment of the wiper device shown in FIG. 2.

The container 1 further comprises a wiper device 9 that is mounted within casing 2, preferably by interference fit, during assembling. Referring particularly to FIGS. 2 and 3, the wiper device 9 comprises a wiper element 10 to be mounted, through engagement means 11, into the casing 2 of the container 1. The wiper element 10, made of a yielding material such as thermoplastic elastomer, is designed to come into contact with the stem 7 and the applicator 6 of cosmetic products, at least when said applicator 6 is being drawn out of casing 2, to remove the excess cosmetic product present on said stem and applicator.

Advantageously and unlike the known art devices, the wiper device 9 in accordance with the present invention further comprises at least one seal 12 connected to the wiper element 10. Seal 12, when the device 9 is mounted to casing 2, is installed close to the opening 3 of casing 2. Said seal 12, made of a yielding material, thermoplastic elastomer for example, abuts against the closing cap 4 and ensures hermetic tightness of the container 1, preventing the cosmetic product from coming out.

Preferably, the means 11 for engagement of the wiper element 10 with casing 2 comprises a main tubular body 13 to be engaged in the opening 3 of casing 2 and having a first edge 14 carrying the seal 12. The tubular body 13, preferably of thermoplastic resin of greater stiffness than that of the seal 12 and the wiper element 10, carries out connection between the seal and wiper element.

In more detail as regards construction of the example herein illustrated, the main tubular body 13 has a side wall 15 that is brought into contact with an inner surface 5*a* of the casing neck 5. The side wall 15 delimits a passageway 16 extending between an inlet 16*a* and an outlet 16*b* thereof. At the inlet 16*a*, a perimetral collar 17 radially-projecting from the side wall 15, defines a first edge 14 and carries the seal 12 that, when the device 9 is mounted on casing 2, faces the base 8 of cap 4. Seal 12 follows the contour of the first edge 14 and has an annular shape.

On the side opposite to the first edge 14, collar 17 delimits an annular surface 18 bearing against an edge 19 of opening 3 (FIG. 1).

For locking of the device 9 at the inside of neck 5, the main tubular body 13 has at least one projection 20 on its side wall 15, which projection can be engaged by snap fitting into a corresponding seat 21 defined in the opening 3 of casing 2. In the embodiment shown, the projection 20 extends circumferentially around the main tubular body 13.

The hermetic tightness of the container is further ensured by an annular projection 22 disposed internally of cap 4 and around the second end 7*b* of stem 7. The annular projection 22 is put into contact relationship with the seal 12 of the wiper device 9 when cap 4 closes casing 2. Preferably, contact between the seal 12 and annular projection 22 takes place on a ridge 23 belonging to the annular projection 22 and on a bevel 12*a* belonging to seal 12.

The wiper element 10 has an annular shape and is installed on a second edge 24 opposite to the first one 14, close to the outlet 16*b* of the main tubular body 13.

In addition, in order to facilitate introduction of applicator 6 into casing 2 and make removal of the product from stem 7 and applicator 6 more efficient during pulling out, the wiper element 10 substantially has a frustoconical or funnel-like shape, tapering towards the bottom of casing 2 and has an end lip 10*a* acting in elastic thrust relationship with the surface of stem 7.

Advantageously, the main body 13, wiper element 10 and seal 12 are obtained by co-moulding, following a process described hereinafter.

To ensure adhesion of the wiper element 10 to the main tubular body 13, a groove 25 is preferably formed in the wiper element 10; this groove 25 is seen in section in the accompanying figures and the second edge 24 of the main tubular body 13 is inserted therein.

In accordance with a first embodiment of the wiper device 9 shown in FIGS. 1 and 2, the wiper element 10 and seal 12 are distinct elements. In addition, an inner surface 29 of the main tubular body 13 is directly exposed to the inside of the passageway 16, delimited by the main tubular body 13 itself. The wiper element 10 comprises a tailpiece 26 delimiting the groove 25 and partly extends in the passageway 16.

In accordance with a second embodiment shown in FIG. 3, the main tubular body 13 has a portion 27 of frustoconical shape close to the outlet 16*b*. In addition and advantageously, an auxiliary body 28 is housed in the main tubular body 13 and lies in contact with the inner surface 29 of the main tubular body 13. The auxiliary body 28, preferably of tubular shape, fully covers the inner surface 29 and extends from seal 12 to the wiper element 10 that are of one piece construction and are disposed at the opposite ends of the auxiliary body itself.

In fact, the auxiliary tubular body 28 is preferably obtained by co-moulding together with the main tubular body 13, the seal 12 and the wiper element 10, and is made up of the same material as the seal and the wiper element 10.

After describing the structure of the wiper device being the object of the invention, a process for manufacturing such a device is set out hereinafter.

The wiper device 9 in reference is advantageously made by co-moulding through use of two moulding dies 30 that, when disposed in side by side relationship with each other, delimit a duct 31 having a first opening 32 and a second opening 33 opposite to the first one 32. Duct 31 extends along a longitudinal axis "X" that, at the end of the process, is coincident with the longitudinal axis of the wiper device 9. The inside of duct 31 has a shape matching the outer shape of the main tubular body 13 (FIG. 4 to the right).

A first core 34 is inserted in the first opening 32 and a second core 35 is inserted in the second opening 33. The first and second cores 34, 35 abut against each other at a contact surface 36 preferably lying transversely of the longitudinal axis "X" and delimit together with duct 31, a first inner volume 37 substantially having the same shape as the main tubular body 13 (FIG. 4 to the left).

Figure 4:
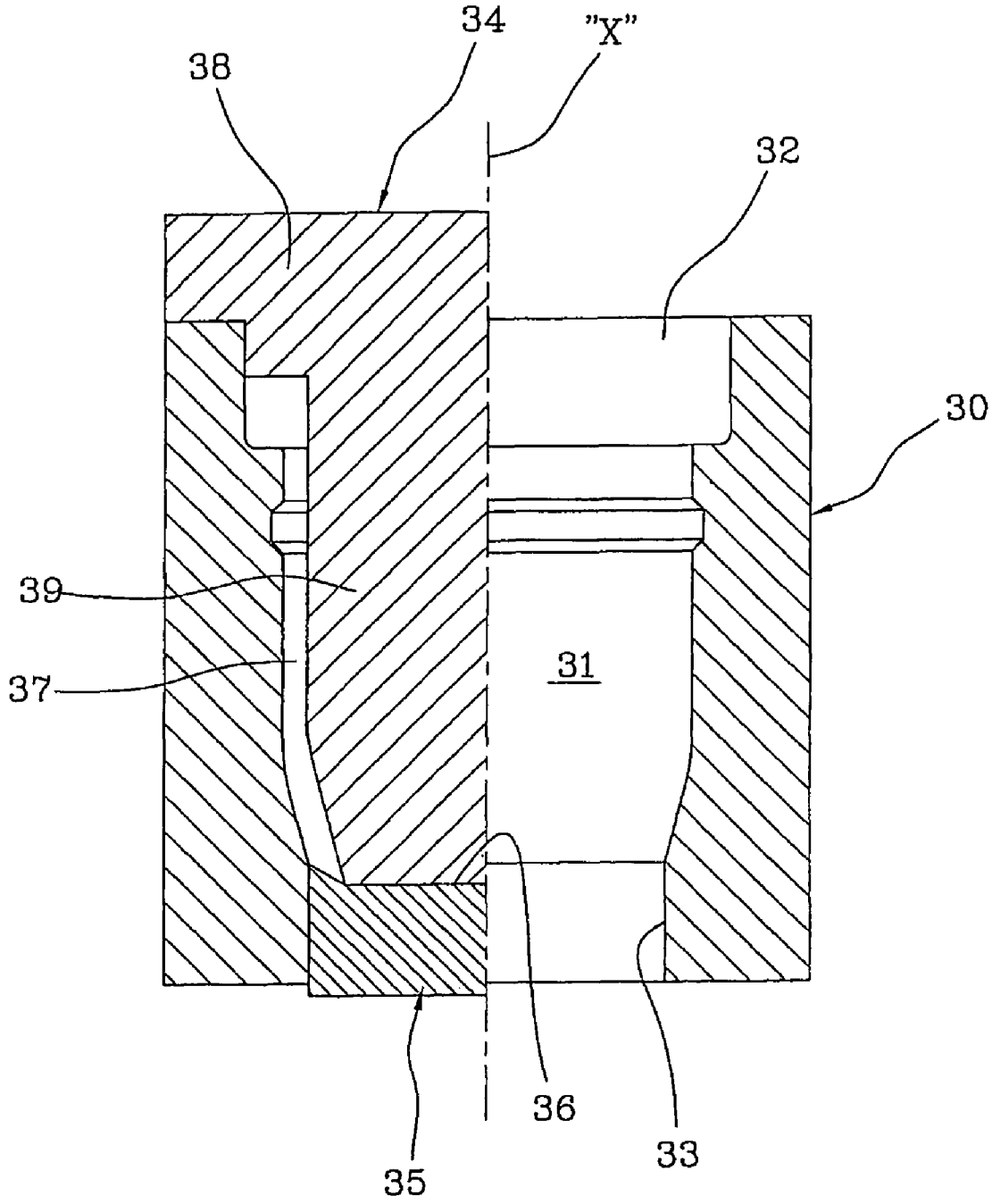
FIG. 4 shows an operating step for manufacturing the wiper device referred to in FIG. 3.

As shown in FIG. 4, the first core 34 comprises a first portion 38 the side surface of which lies in abutment against the dies 30, and a second portion 39 axially in alignment with the first one 38 and having a shape matching the inner shape of the main tubular body 13. The second core 35 has a side surface lying in abutment against the dies 30 so as to complete closure of the first inner volume 37.

Subsequently, a first material in a fluid state is introduced into the first inner volume 37, waiting until solidification of same and formation of the main tubular body 13.

Figure 5:
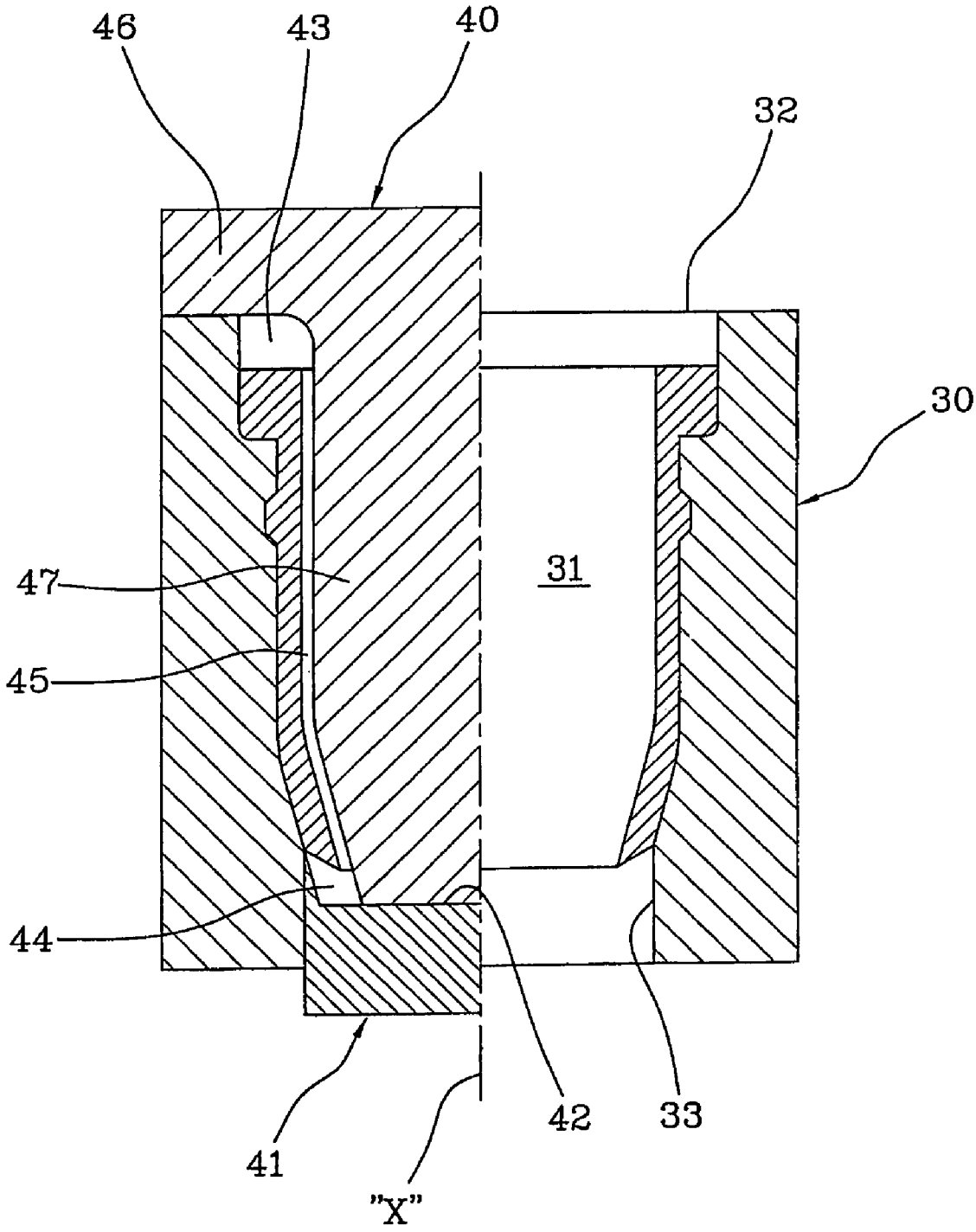
FIG. 5 shows a further operating step for manufacturing the wiper device referred to in FIG. 3.

When solidification has occurred, the first 34 and second 35 cores are removed (FIG. 5 to the right) and replaced by a third core 40, introduced into the first opening 32, and a fourth core 41 introduced into the second opening 33 (FIG. 5 to the left).

The third and fourth cores 40, 41 abut against each other at a contact surface 42 preferably lying transverse to the longitudinal axis "X" and together with duct 31 and the already formed main tubular body 13 delimit a second inner volume 43 located close to the first edge 14 of the main tubular body 13 and a third inner volume 44 located close to the second edge 24 of the main tubular body 13.

For manufacture of the device in accordance with FIG. 3, the third 40 and fourth 41 cores, duct 31 and the main tubular body 13 delimit a single auxiliary volume 45 which is coaxial with the main tubular body 13 and includes the second inner volume 43 and third inner volume 44. The preferably tubular auxiliary volume 45 defines the auxiliary body 28 associated with the main tubular body 13 and carrying the seal 12 and wiper element 10.

In accordance with the illustration in FIG. 5, the third core 40 too, in the same manner as the first core 34, has a first portion 46 acting in abutment against the dies 30, and a second portion 47 axially in alignment with the first one 46 and having a shape matching the inner shape of the auxiliary tubular body 28. The fourth core 41 has a side surface lying in abutment against the dies 30 so that closure of the auxiliary volume 45 is completed.

A second material in a fluid state is introduced into the auxiliary volume 45, waiting until solidification of same and formation of the auxiliary body 28 that together with the wiper element 10, seal 12 and main auxiliary body 13 forms the wiper device 9.

Finally, the third 40 and fourth 41 cores are removed and the two dies 30 are moved away from each other to enable removal of device 9.

The process for manufacturing the device in accordance with the first embodiment shown in FIG. 2 is quite similar to the above described one except for the fact that the second and third inner volumes 43, 44 are separated and the dies 30 with cores 40, 41 do not delimit any single tubular volume 45.

In any case, using the same reference numerals for the same elements in the two embodiments, the second material in a fluid state is introduced separately into the second and third inner volumes 43, 44. Solidification of the second material leads to formation of seal 12, in the second inner volume 43, and of the wiper element 10 in the third inner volume 44, said pieces together with the main tubular body 13 defining the wiper device 9.

The wiper device, the container and the process being the object of the present invention solve the problems found in the known art and achieve the intended purposes.

In fact, the wiper device in accordance with the present invention comprises the seal of the container that therefore must not be applied to the cap by means of a further production step.

The possibility of manufacturing the main body 13 using a relatively rigid material facilitates the operations for assembling the device 9 into the container through forced fitting, while the relatively soft material that can be used for obtaining the seal and the wiper ensures a perfect action of these components against the surfaces of the cap 4 and the stem 7 respectively, without needing precise working tolerances.

In addition, co-moulding of the main tubular body, the seal and the wiper element ensures a perfect union between the parts and is a guarantee of the product quality.

Finally, the process being the object of the invention enables a reduction in the manufacturing steps of the device and the container and an increase in the production speed.

The invention claimed is:

1. A wiper device for containers of cosmetic products, comprising:

a wiper element (10) to be mounted in a casing (2) of a container (1) of cosmetic products, and designed to come into contact with an applicator (6) of cosmetic products housed in the casing (2), at least during pulling out of said applicator (6) from the casing (2);

at least one seal (12) connected to the wiper element (10), said at least one seal (12) being adapted for installation close to an opening (3) of the casing (2) and being susceptible of abutment against a closing cap (4) of the container (1);

a main tubular body (13) to be engaged in the opening (3) of the casing (2) and having a first edge (14) carrying said at least one seal (12), said at least one seal (12) and the wiper element (10) being made of a material having a lower stiffness than that of the main tubular body (13);

wherein the wiper element (10) has a substantially frusto-conical and annular shape, wherein the wiper element (10) is installed on a second edge (24) of the main tubular body (13), wherein the second edge is opposite to the first edge.

2. A device as claimed in claim 1, wherein the wiper element (10) has a groove (25) for insertion of the second edge (24) of the main tubular body (13).

3. A device as claimed in claim 1, wherein the main tubular body (13) is made of a polymeric material having a higher stiffness than that of the seal (12) and the wiper element (10).

4. A device as claimed in claim 1, wherein the wiper element (10) is made of the same material as the seal (12).

5. A device as claimed in claim 1, further comprising an auxiliary body (28) extending against an inner wall (29) of said main tubular body (13) and made of the same material as the seal (12) and the wiper element (10) disposed at a first and a second ends respectively of the auxiliary body (28).

6. A device as claimed in claim 5, wherein the auxiliary body (28) has a tubular conformation and completely covers the inner wall (29) of the main tubular body (13).

7. A device as claimed in claim 1, wherein the main tubular body (13) can be engaged by interference fit in the opening (3) of the casing (2).

8. A device as claimed in claim 1, wherein the main tubular body (13) has on a side surface (15) thereof, at least one projection (20) to be engaged in a corresponding seat (21) defined in the opening (3) of the casing (2).

9. A container for cosmetic products, comprising:

a casing (2) designed to hold a cosmetic product and having an opening (3);

a cap (4) removably mounted on the casing (2) to close the opening (3);

an applicator (6) integral with the cap (4) and located within the casing (2), to be dipped into the cosmetic product;

wherein the container further comprises a wiper device (9) as claimed in claim 1.

10. A container as claimed in claim 9, wherein the cap (4) has an inner annular projection (22) put in contact relationship with the seal (12) of the wiper device (9) when said cap (4) is disposed on the casing (2) to close it.

11. A process for manufacturing a wiper device for cosmetic product containers, wherein said process comprises the following steps:

moving two moulding dies (30) close to each other, said dies delimiting a duct (31) having a first opening (32) and a second opening (33) opposite to the first one (32) and internally having a shape matching the outer shape of a main tubular body (13);

inserting a first core (34) into the first opening (32);

inserting a second core (35) into the second opening (33) and make the second core (35) abut against the first core (34); said first (34) and second (35) cores and duct (31) delimiting a first inner annular volume (37) having the shape of a main tubular body (13) of a wiper device;

introducing a first material in a fluid state into the first inner volume (37), waiting for solidification and formation of the main tubular body (13);

removing the first (34) and second (35) cores;

inserting a third core (40) into the first opening (32);

inserting a fourth core (41) into the second opening (33) and make the fourth core (41) abut against the third core (40); said third (40) and fourth (41) cores, duct (31) and main tubular body (13) delimiting a second inner volume (43) located close to a first edge (14) of the main tubular body (13) and a third inner volume (44) located close to a second edge (24) of the main tubular body (13);

introducing a second material in a fluid state into the second and third inner volumes (43, 44), waiting for solidification and formation of a seal (12) in the second inner volume (43) and of a wiper element (10) in the third inner volume (44), said seal and wiper element together with said main tubular body (13) forming a wiper device (9);

removing the third (40) and fourth (41) cores; and pulling the wiper device (9) out of the moulding dies (30).

12. A process as claimed in claim 11, wherein the third (40) and fourth (41) cores, duct (31) and main tubular body (13) delimit an auxiliary tubular volume (45) coaxial with said main tubular body (13) and including the second inner volume (43) and third inner volume (44), to define an auxiliary tubular body (28) associated with the main tubular body (13) and comprising the seal (12) and the wiper element (10).

* * * * *